US006647812B2

(12) United States Patent
Nito et al.

(10) Patent No.: US 6,647,812 B2
(45) Date of Patent: Nov. 18, 2003

(54) STARTER MOTOR HAVING INTERMEDIATE GEAR

(75) Inventors: Kuniaki Nito, Kariya (JP); Shinji Ando, Nagoya (JP); Yasuyuki Wakahara, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/977,682

(22) Filed: Oct. 16, 2001

(65) Prior Publication Data

US 2002/0069713 A1 Jun. 13, 2002

(30) Foreign Application Priority Data

Dec. 8, 2000 (JP) ..... 2000-373758

(51) Int. Cl.[7] ..... F02N 15/06
(52) U.S. Cl. ..... 74/6
(58) Field of Search ..... 74/6, 7 A, 7 B, 74/7 E, 7 R; 403/396

(56) References Cited

U.S. PATENT DOCUMENTS 3,851,532 A * 12/1974 Pfluger et al. ..... 74/7 A
4,789,249 A * 12/1988 Mutolo ..... 384/43
4,868,407 A * 9/1989 Isozumi et al. ..... 290/48
5,042,312 A * 8/1991 Giometti ..... 74/6
5,165,293 A * 11/1992 Kittaka et al. ..... 74/7 A
5,244,104 A * 9/1993 Green et al. ..... 211/150
5,271,285 A * 12/1993 Silliman et al. ..... 74/9
5,277,075 A * 1/1994 Sakamoto et al. ..... 74/7 R
5,423,156 A * 6/1995 Nellessen, Jr. ..... 52/715
5,706,699 A 1/1998 Moribayashi ..... 74/7 A
5,731,638 A * 3/1998 Niimi ..... 290/38 R
5,844,336 A * 12/1998 Ohya et al. ..... 2/206
5,987,709 A * 11/1999 Chou ..... 24/116 A
6,089,112 A * 7/2000 Kelly et al. ..... 74/7 C
6,257,602 B1 * 7/2001 Joerg et al. ..... 280/93.514

FOREIGN PATENT DOCUMENTS

JP U-50-91643 8/1975

* cited by examiner

*Primary Examiner*—David A. Bucci
*Assistant Examiner*—Julie K. Smith
(74) *Attorney, Agent, or Firm*—Posz & Bethards, PLC

(57) ABSTRACT

A starter motor includes an intermediate gear engaging with and driven by a pinion connected to an output shaft of an electrical motor. The intermediate gear is coupled to the pinion by means of a retainer to be shifted in its axial direction together with the pinion. The intermediate gear engages with a ring gear of an engine to crank up the engine when it is shifted in the axial direction. The retainer is connected to a pinion boss by forcibly enlarging a resilient opening of its groove, and the resilient opening recovers its original position after the retainer is connected to the pinion boss. In this manner, the retainer is prevented from dropping off from the pinion boss during an assembling process of the starter motor. The retainer is made of resin to have an enough thickness to secure a sufficient mechanical strength.

6 Claims, 2 Drawing Sheets

STARTER MOTOR HAVING INTERMEDIATE GEAR

CROSS-REFERENCE TO RELATED APPLICATION

This application is based upon and claims benefit of priority of Japanese Patent Application No. 2000-373758 filed on Dec. 8, 2000, the content of which is incorporated herein by reference.

BACKGROUND OF THE INVENTION

1. Field of the Invention

The present invention relates to a starter motor having an intermediate gear, in which a rotational torque of an output shaft of a motor is transferred to an internal combustion engine through an intermediate gear.

2. Description of Related Art

An example of the starter motors of this kind is disclosed in JP-U-50-91643. The intermediate gear structure disclosed in this publication is briefly shown in FIGS. 4A and 4B attached to this specification. As shown in FIG. 4A, an intermediate shaft 110 is disposed in parallel to an output shaft 100 of a motor. The intermediate shaft 110 rotatably supports an intermediate gear 130 that engages with a pinion 120 supported on the output shaft 100 and rotated by the motor. A coupler 140 that connects the pinion 120 to the intermediate gear 130 to slidably drive the intermediate gear 130 in an axial direction of the intermediate shaft 110 together with the pinion 120 is disposed in circular grooves 121, 131 formed on both the pinion 120 and the intermediate gear 130.

To start up the internal combustion engine, the pinion 120 is shifted rightward in FIG. 4A, and the intermediate gear 130 is also shifted rightward together with the pinion 120, thereby engaging with a ring gear 150 of the engine. The rotational torque of the motor is transferred to the ring gear 150 of the engine through the pinion 120 and the intermediate gear 130. When the pinion 120 and the intermediate gear 130 rotate, the coupler 140 does not rotate because its arcuate arms 141, 142 (shown in FIG. 4B) stay in the circular grooves 121, 131, respectively.

However, in the conventional structure, there has been a problem in assembling the intermediate gear 130 to the pinion 120. The coupler 140 easily drops off from the circular grooves 121, 131 in the assembling process because it is only loosely positioned in the circular grooves. Accordingly, it has been difficult to keep the coupler 140 in the position in the assembling process. Further, there has been another problem that it is difficult to give a sufficient mechanical strength to the coupler 140 because it must be positioned in thin circular grooves 121, 131 formed on the pinion 120 and the intermediate gear 130. Especially, it has been difficult to secure a sufficient bending strength of the coupler 140, because the coupler 140 must be made thin to be accommodated in the circular grooves 121, 131.

SUMMARY OF THE INVENTION

The present invention has been made in view of the above-mentioned problems, and an object of the present invention is to provide an improved starter motor having an intermediate gear, in which a pinion and the intermediate gear is coupled with an easily mountable retainer having a sufficient mechanical strength.

A starter motor for cranking an internal combustion engine includes a pinion driven by an electrical motor and an intermediate gear engaged with the pinion. The intermediate gear engages with a ring gear of the internal combustion engine to crank up the engine. The pinion is slidably and rotatably supported on an output shaft of the motor, while the intermediate gear is slidably and rotatably supported on an intermediate shaft disposed in parallel to the output shaft. The pinion and the intermediate gear are coupled with a retainer, so that the intermediate gear is shifted in its axial direction together with the pinion when the pinion is shifted to crank up the engine.

The retainer has a first groove engaging with a pinion boss formed integrally with the pinion and a second groove positioned to partly cover an outer periphery of a cylindrical boss formed integrally with the intermediate gear. The first groove has a resilient opening, a width of which is smaller than a diameter of the pinion boss. To connect the retainer to the pinion boss, the resilient opening is forcibly opened and recovers its original position after the retainer is connected to the pinion boss. Since the retainer is connected to the pinion boss in this manner, the retainer is prevented from dropping off during a process of assembling the intermediate gear to the starter motor. The positions of the first and the second grooves of the retainer may be reversed so that the retainer engages with the cylindrical boss of the intermediate gear in place of the pinion boss. Since the retainer is positioned outside the pinion boss and the cylindrical boss of the intermediate gear, the retainer can be made thick enough to secure a sufficient mechanical strength.

The retainer coupling the pinion and the intermediate gear does not rotate, while components contacting the retainer rotate. Convex surfaces are formed on the side surfaces of the retainer contacting the rotating components to alleviate friction between the retainer and the components.

According to the present invention, the retainer having a sufficient mechanical strength can be easily mounted on the starter motor without disturbing the assembling process. Further, friction between the retainer and rotating components is effectively alleviated.

Other objects and features of the present invention will become more readily apparent from a better understanding of the preferred embodiment described below with reference to the following drawings.

DETAILED DESCRIPTION OF THE PREFERRED EMBODIMENT

Figure 1:
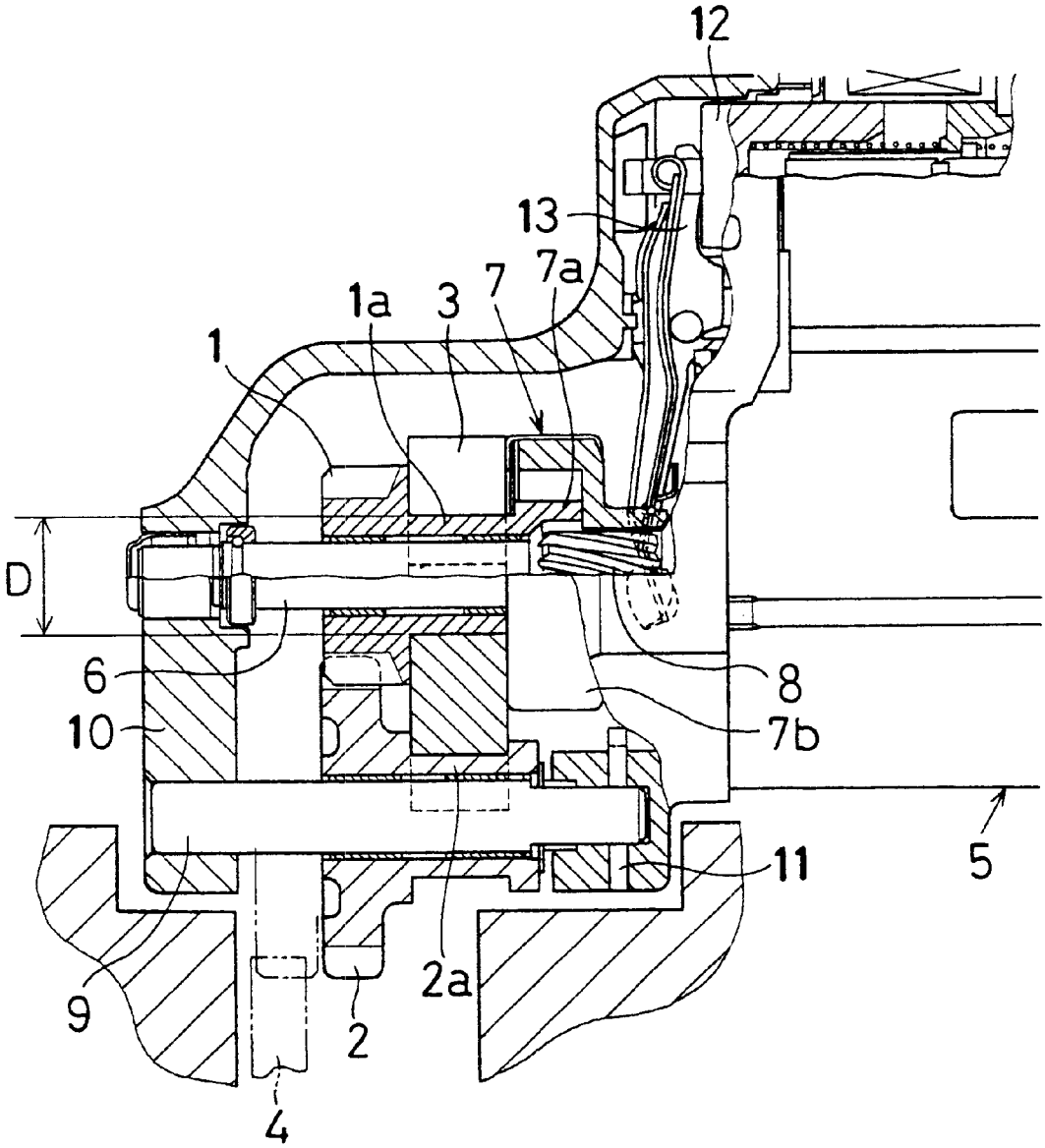
FIG. 1 is a cross-sectional view showing a portion of a starter motor, which is relevant to the present invention.

A preferred embodiment of the present invention will be described with reference to FIGS. 1–3. As shown in FIG. 1, a starter motor includes an intermediate gear 2 engaging with a pinion 1 driven by a motor 5. The pinion 1 and the intermediate gear 2 are coupled by a retainer 3, so that the intermediate gear 2 is shifted leftward in FIG. 1 together with the pinion 1 when the pinion 1 is shifted leftward. When the intermediate gear 2 is shifted leftward, it engages with a ring rear 4 of an internal combustion engine, and the engine is driven by the motor.

The pinion 1 is supported on an output shaft 6 of the motor 5 and driven by the motor 5 through a one-way clutch 7. The one-way clutch 7 is connected to the output shaft 6 via a helical spline 8 formed on the output shaft 6, so that it shifts in the axial direction of the output shaft 6. The pinion 1 is connected to a clutch inner 7*a* via a pinion boss 1*a*. The pinion 1, the pinion boss 1*a* and the clutch inner 7*a* are all integrally formed.

The intermediate gear 2 is rotatably and slidably supported on an intermediate shaft 9. The intermediate shaft 9 is held in a housing 10 in parallel to the output shaft 6, and its rotation and movement in the axial direction are restricted by a circular clip 11. A cylindrical boss 2*a* integrally formed with the intermediate gear 2 is also supported on the intermediate shaft 9. A retainer 3 is coupled to the pinion boss 1*a* and cylindrical boss 2*a,* so that the pinion 1 and the intermediate gear 2 move together in the axial direction. When both the pinion 1 and the intermediate gear 2 rotate, the retainer 3 does not rotate.

Figure 2:
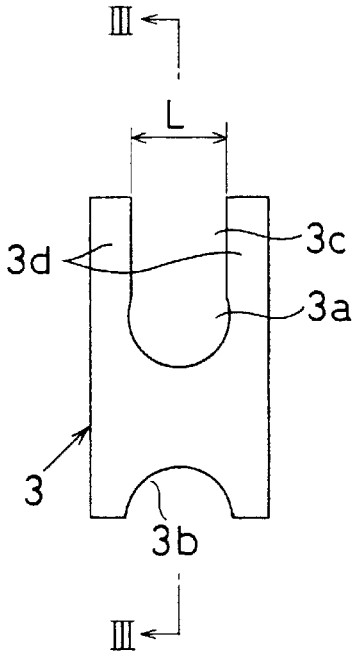
FIG. 2 is a plan view showing a retainer coupling a pinion and an intermediate gear of the starter motor shown in FIG. 1.
Figure 3:
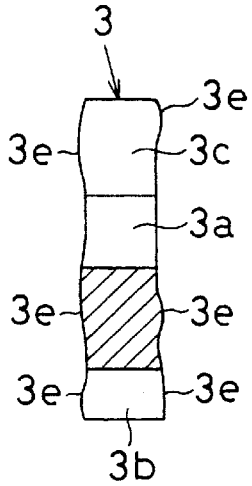
FIG. 3 is a cross-sectional view showing the retainer shown in FIG. 2, taken along line III—III in FIG. 2.
Figure 4A:
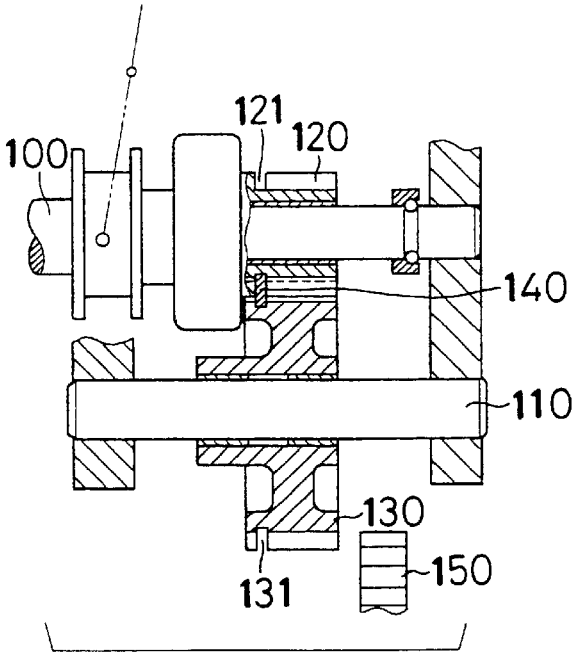
FIG. 4A PRIOR ART
FIG. 4A is a cross-sectional view showing a coupling structure of a pinion and an intermediate gear in a conventional starter motor.
Figure 4B:
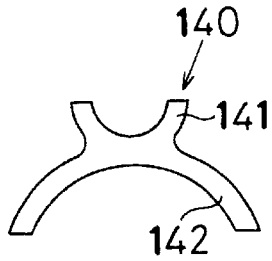
FIG. 4B PRIOR ART
FIG. 4B is a plan view showing a coupler used in the starter motor shown in FIG. 4A.

As shown in FIGS. 2 and 3, the retainer 3 made of resin is substantially block-shaped and has a first groove 3*a* engaging with the pinion boss 1*a* and a second groove 3*b* engaging with the cylindrical boss 2*a* of the intermediate gear 2. The first groove 3*a* includes an opening 3*c* formed between a pair of side lips 3*d.* The width L of the opening 3*c* (shown in FIG. 2) is made a little smaller than a diameter D of the pinion boss 1*a* (shown in FIG. 1). The opening 3*c* of the retainer 3 is resiliently opened to connect the first groove 3*a* to the pinion boss 1*a,* and the opening 3*c* returns to its original dimension after the retainer 3 is connected to the pinion boss 1*a.* The second groove 3*b* is positioned to partially cover the outer periphery of the cylindrical boss 2*a* of the intermediate gear 2. The positions of the first groove 3*a* and the second groove 3*b* may be reversed, so that the first groove 3*a* engages with the cylindrical boss 2*a* and the second groove 3*b* is positioned to partially cover the outer periphery of the pinion boss 1*a*.

As shown in FIG. 3, convex surfaces 3*e* are formed on both side surfaces of the retainer 3 at positions where the retainer 3 axially contacts other components, i.e., the pinion 1, the intermediate gear 2 and a clutch over 7*b.* In this manner, axial frictional force between the retainer 3 that is not rotated and components rotating in contact with the retainer 3 is alleviated.

Now, the operation of the starter motor will be briefly described. The output shaft 6 of the motor 5 is rotated when electrical power is supplied to the motor 5. The rotational torque of the output shaft 6 is transferred to the pinion 1 via the one-way clutch 7, thereby rotating the pinion 1. The intermediate gear 2 engaging with the pinion 1 is also rotated. At the same time when the electrical power is supplied to the motor 5, the lever 13 is driven by a plunger 12 to shift the one-way clutch 7 leftward (in FIG. 1). As the one-way clutch 7 is driven leftward, the pinion 1 formed integrally with the clutch inner 7*a* is shifted leftward. The intermediate gear 2 coupled with the pinion 1 by the retainer 3 is also sifted leftward, thereby engaging with the ring gear 4. Thus, the rotational torque of the motor 5 is transferred to the ring gear 4 through the pinion 1 and the intermediate gear 2 thereby to crank up the internal combustion engine.

According to the present invention, the following advantages are obtained. Since the pinion 1 and the intermediate gear 2 are coupled by disposing the retainer 3 in engagement with the pinion boss 1*a* and the cylindrical boss 2*a,* the thickness of the retainer 3 can be made as thick as the length of the pinion boss 1*a* and the cylindrical boss 2*a* permit. Therefore, the retainer 3 can be made to have a thickness to secure a sufficient mechanical strength. Thus, the retainer 3 can cope with a high bending force applied thereto when the intermediate gear 2 abuts the ring gear 4. In addition, since the retainer 3 is substantially block-shaped and has a sufficient thickness, stress concentration to a certain portion is avoided.

Since the retainer 3 is engaged with the pinion boss 1*a* by resiliently enlarging its opening 3*c,* the retainer 3 can be kept engaged during a process of assembling the intermediate gear 2. It is not necessary to keep the retainer 3 in the position during the assembling process. Therefore, the intermediate gear 2 is easily assembled.

The retainer 3 itself does not rotate while other components contacting the retainer 3 rotate. Since the convex surfaces 3*e* are formed on the side surfaces of the retainer 3, frictional force between the retainer 3 and contacting components is alleviated.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter motor for cranking an internal combustion engine having a ring gear, the starter motor comprising:

an output shaft rotated by a motor;

a pinion slidably and rotatably supported on the output shaft, wherein the pinion is adapted to be rotated by rotation of the output shaft, and the pinion is connected to a pinion boss;

a one-way clutch coupled to the pinion boss at an end of the pinion boss, wherein an axial space exists between the pinion and the one-way clutch;

an intermediate shaft that is parallel to the output shaft;

an intermediate gear that is slidably and rotatably supported on the intermediate shaft, wherein the intermediate gear is engaged with the pinion such that the intermediate gear is rotated by the pinion, and the intermediate gear is adapted to be engaged with the ring gear of the internal combustion engine, wherein the intermediate gear is connected to a cylindrical boss; and a retainer having a first groove engaged with the pinion boss and a second groove coupled with the cylindrical boss of the intermediate gear, wherein the retainer is located in the axial space between the pinion and the one-way clutch, so that the intermediate gear is driven in its axial direction together with the pinion, and wherein the first groove of the retainer has a pair of resilient lips, between which an opening is formed, and the lips extend radially beyond the position of the outer periphery of the pinion.

2. The starter motor as in claim 1, wherein the retainer is substantially block-shaped, and the retainer has an axial length that is substantially equal to the axial length of the axial space between the pinion and the one-way clutch.

3. The starter motor as in claim 1, wherein a width dimension of the resilient opening is smaller than the diameter of the pinion boss.

4. The starter motor as in claim 1, wherein the retainer includes convex side surfaces that contact rotating components positioned in contact with the retainer.

5. The starter motor as in claim 1, wherein the lips extend radially to the position of the other periphery of the one-way clutch.

6. A starter motor for cranking an internal combustion engine having a ring gear, the starter motor comprising:

an output shaft rotated by a motor;

a pinion slidably and rotatably supported on the output shaft, wherein the pinion is adapted to be rotated by rotation of the output shaft, and the pinion is connected to a pinion boss;

a one-way clutch coupled to the pinion boss at an end of the pinion boss, wherein an axial space exists between the pinion and the one-way clutch;

an intermediate shaft that is parallel to the output shaft;

an intermediate gear that is slidably and rotatably supported on the intermediate shaft, wherein the intermediate gear is engaged with the pinion such that the intermediate gear is rotated by the pinion, and the intermediate gear is adapted to be engaged with the ring gear of the internal combustion engine, wherein the intermediate gear is connected to a cylindrical boss; and a retainer having a first groove engaged with the pinion boss and a second groove coupled with the cylindrical boss of the intermediate gear, wherein the retainer is located in the axial space between the pinion and the one-way clutch, so that the intermediate gear is driven in its axial direction together with the pinion, wherein the retainer is substantially block-shaped, and the axial length of the retainer is substantially equal to the axial length of the axial space.

* * * * *